US007251430B2

(12) United States Patent
Nishikawa

(10) Patent No.: US 7,251,430 B2
(45) Date of Patent: Jul. 31, 2007

(54) IMAGE FORMING APPARATUS

(75) Inventor: Akihiro Nishikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/354,084

(22) Filed: Feb. 15, 2006

(65) Prior Publication Data

US 2006/0210300 A1 Sep. 21, 2006

(30) Foreign Application Priority Data

Mar. 16, 2005 (JP) ..... 2005-074964

(51) Int. Cl.
*G03G 15/00* (2006.01)
*G03G 21/00* (2006.01)

(52) U.S. Cl. ..... 399/71; 399/123; 399/101; 399/345; 399/349; 399/354

(58) Field of Classification Search ..... 399/34, 399/71, 123, 101, 345, 349, 353, 354, 297
See application file for complete search history.

(56) References Cited

U.S. PATENT DOCUMENTS

| | | | | |
|---|---|---|---|---|
| 5,493,383 | A * | 2/1996 | Pozniakas et al. | 399/345 |
| 5,797,063 | A * | 8/1998 | Umezawa et al. | 399/34 |
| 2003/0161652 | A1* | 8/2003 | Nishiwaki | 399/101 |
| 2006/0083539 | A1 | 4/2006 | Nishikawa | 399/101 |

FOREIGN PATENT DOCUMENTS

| | | | |
|---|---|---|---|
| JP | 05281882 | A * | 10/1993 |
| JP | 05-289593 | | 11/1993 |
| JP | 10-149033 | | 6/1998 |
| JP | 2000-187396 | | 7/2000 |
| JP | 2002-207403 | | 7/2002 |
| JP | 2002-229344 | | 8/2002 |

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

An image forming apparatus has: an image bearing member that bears a toner image and moves; a transfer means that transfers the toner image on the image bearing member to a transfer medium; a first eliminating member that comes in contact with the image bearing member and collects and eliminates the toner on the image bearing member by applying a bias in a first eliminating area where toner is eliminated from the image bearing member; a second eliminating member that comes in contact with the image bearing member so as to eliminate the toner on the image bearing member in a second eliminating area where the toner remaining on the image bearing member from which the toner is eliminated in the first eliminating area is eliminated; a controller that variably controls a bias condition of the bias to be applied to the first eliminating means based on a relationship between voltage and electric current when a test bias is applied to the first eliminating means in contact with the image bearing member; and a separating member that separates the second eliminating means from the image bearing member when a part of the image bearing member which passes through the first eliminating area during application of the test bias to the first eliminating means is in the second eliminating area.

8 Claims, 8 Drawing Sheets

IMAGE FORMING APPARATUS

BACKGROUND OF THE INVENTION

1. Field of the Invention

The present invention relates to an eliminating member that eliminates toner on an image bearing member, and particularly relates to an image forming apparatus that has a first eliminating member to which bias is applied and which comes in contact with the image bearing member so as to eliminate toner and a second eliminating member which comes in contact with the image bearing member so as to eliminate the toner.

2. Description of the Related Art

In recent years, from the viewpoint of reduce in printing cost, a toner eliminating means of an image bearing member has desirably long life.

A first eliminating member comes in contact with the image bearing member so as to apply a bias to the member and collects and eliminates toner. Since deterioration of an eliminating ability due to abrasion of the first eliminating member hardly occurs, this member is suitably used for a long time. A charging amount of some toner on the image bearing member, however, is small, and it is difficult that such toner is sufficiently eliminated by the first eliminating member that collects toner electrostatically.

In order to compensate the eliminating ability of the first eliminating member, therefore, a second eliminating member that comes in contact with the image bearing member so as to eliminate toner is provided. In the first eliminating member that collects toner by application of bias, a resistance value changes due to adhesion of toner. In order to apply suitable bias according to the change in the resistance value, a condition of the bias to be applied to the first eliminating member is controlled based on a relationship between a voltage and an electric current at the time of applying test bias to the first eliminating member.

When, however, the test bias is applied, the toner borne by the first eliminating member occasionally transfers to the image bearing member. That is to say, in the case where the test bias is lower than an adequate bias, electrostatic binding force of the toner is weakened, and thus the toner transfers. On the contrary, in the case where the test bias is higher than the adequate bias, discharge occurs between the first eliminating member and the image bearing member so that the toner is charged, and thus the toner transfers.

The transferred toner moves together with the image bearing member, and is accumulated on a contact portion between the second eliminating member and the image bearing member. The accumulated toner is pushed against the image bearing member by the second eliminating member, so that the toner adheres to the image bearing member.

SUMMARY OF THE INVENTION

It is an object of the present invention to prevent toner which transfers from a first eliminating member to an image bearing member due to application of a test bias from being accumulated on a contact portion between a second eliminating member and the image bearing member.

Further, it is another object of the present invention to provide an image forming apparatus having:

an image bearing member that bears a toner image and moves;

a transfer means that transfers the toner image on the image bearing member to a transfer medium;

a first eliminating means that comes in contact with the image bearing member and collects and eliminates the toner on the image bearing member by applying a bias in a first eliminating area where the toner is eliminated from the image bearing member;

a second eliminating means that comes in contact with the image bearing member so as to eliminate the toner on the image bearing member in a second eliminating area where the toner remaining on the image bearing member where the toner is eliminated in the first eliminating area is eliminated;

a control means that variably controls a bias condition of the bias to be applied to the first eliminating means based on a relationship between voltage and electric current at the time of applying test bias to the first eliminating means in contact with the image bearing member; and a separating means that separates the second eliminating means from the image bearing member when a portion of the image bearing member which passes through the first eliminating area during the application of the test bias to the first eliminating means is in the second eliminating area.

DESCRIPTION OF THE PREFERRED EMBODIMENT

In the present embodiment, a separating means is provided so as to separate a second cleaning member 130 (second eliminating means) from an image bearing member (intermediate transfer belt 181) when a portion of the image bearing member (intermediate transfer belt 181) which passes through a first cleaning area C1 (first eliminating area) is present in a second cleaning area C2 (second eliminating area) while a test bias is being applied to a cleaning member 115 (first eliminating means). As a result, toner which transfers from the first cleaning member 115 to the intermediate transfer belt by applying the test bias is prevented from being accumulated on the second cleaning area C2, so that adhesion of the toner to the intermediate transfer belt 181 is suppressed.

An image forming apparatus according to one embodiment of the present invention is explained below concretely with reference to the drawings.

FIRST EMBODIMENT

Figure 1:
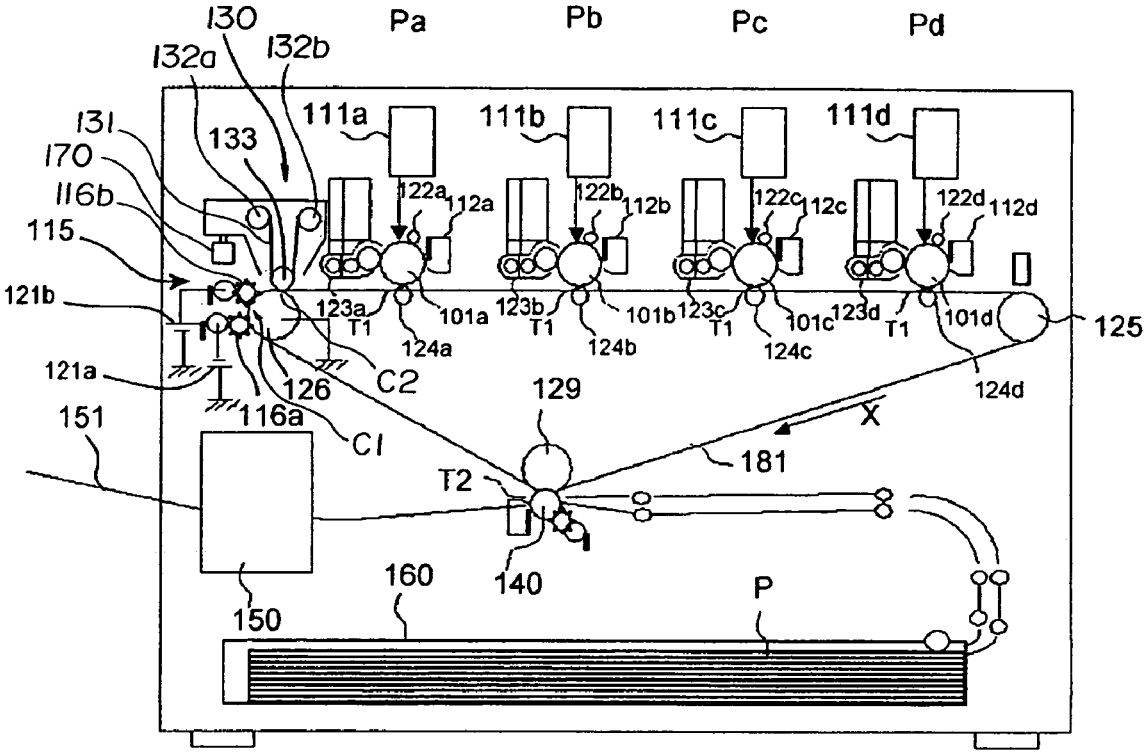
FIG. 1 is a sectional view explaining an image forming apparatus.
Figure 2:
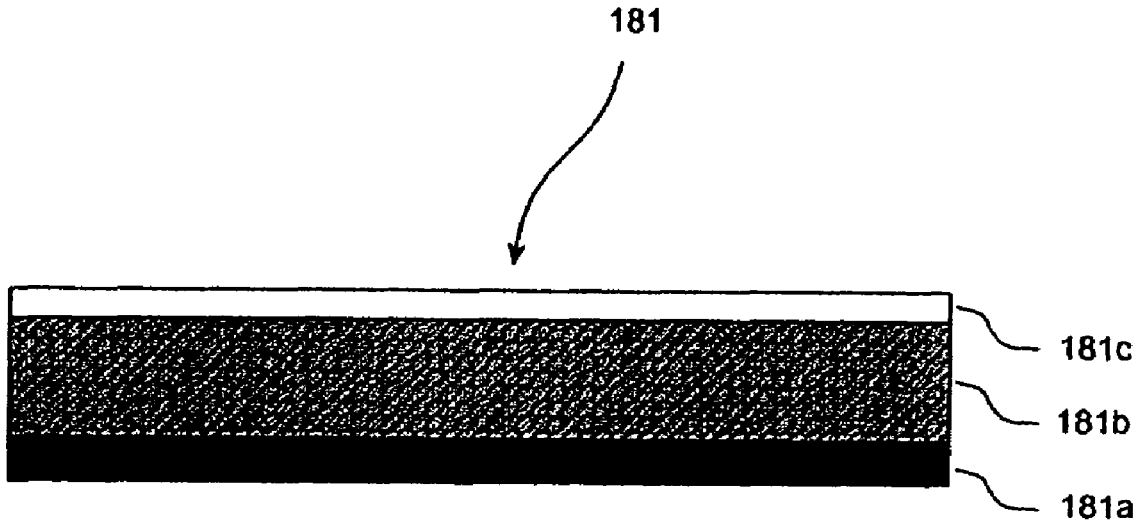
FIG. 2 is a sectional view explaining an intermediate transfer belt.
Figure 3:
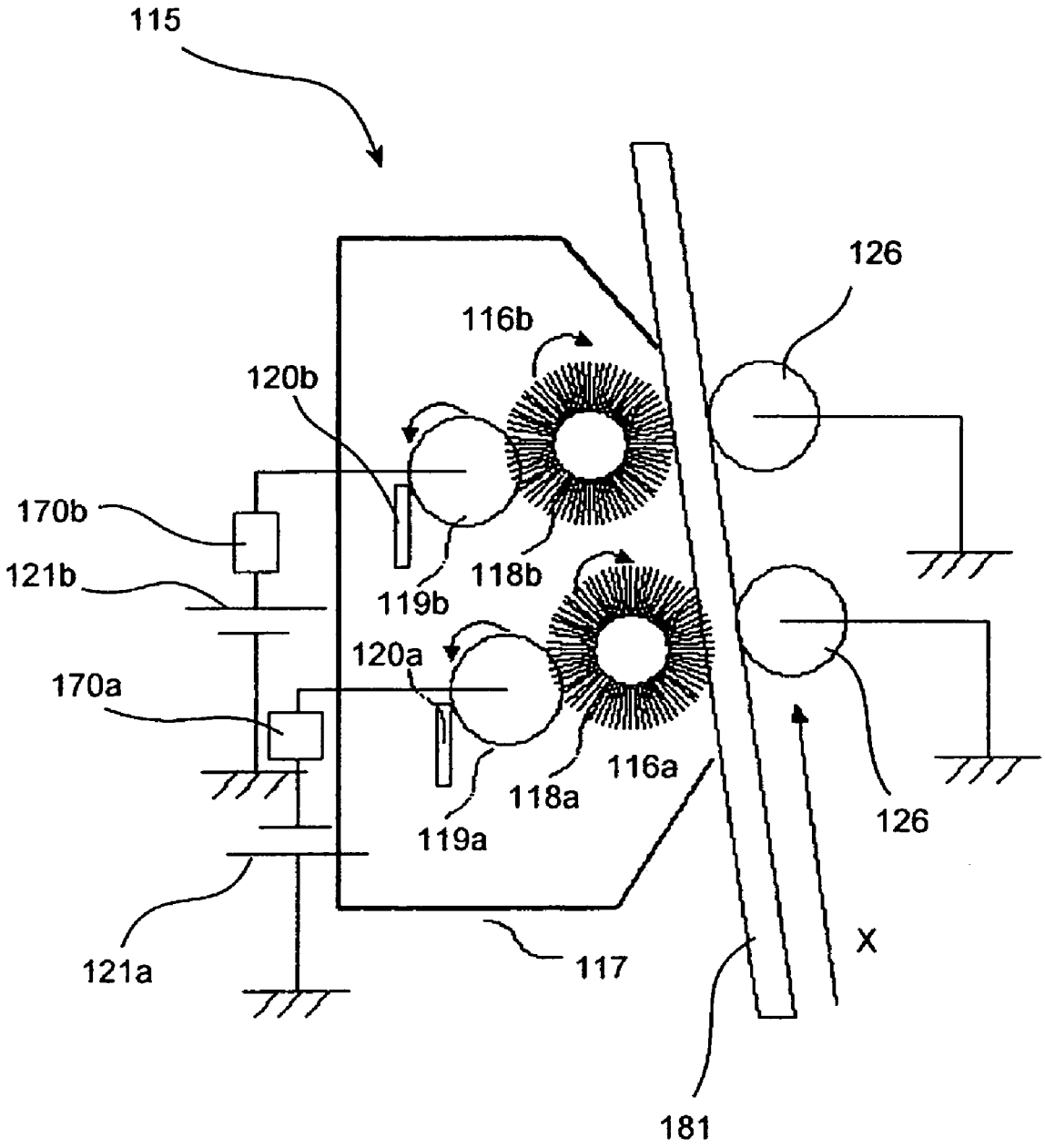
FIG. 3 is an explanatory diagram of an intermediate transfer member cleaning means.
Figure 4:
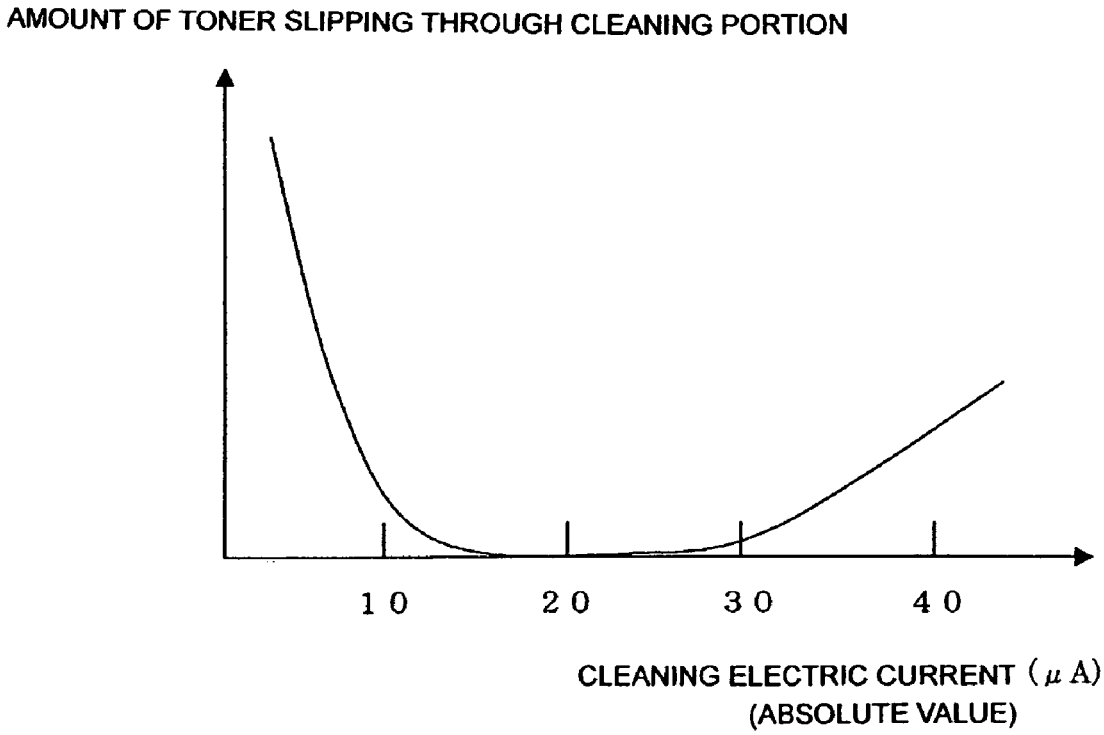
FIG. 4 is a graph illustrating a relationship between cleaning current and toner slipping.
Figure 5:
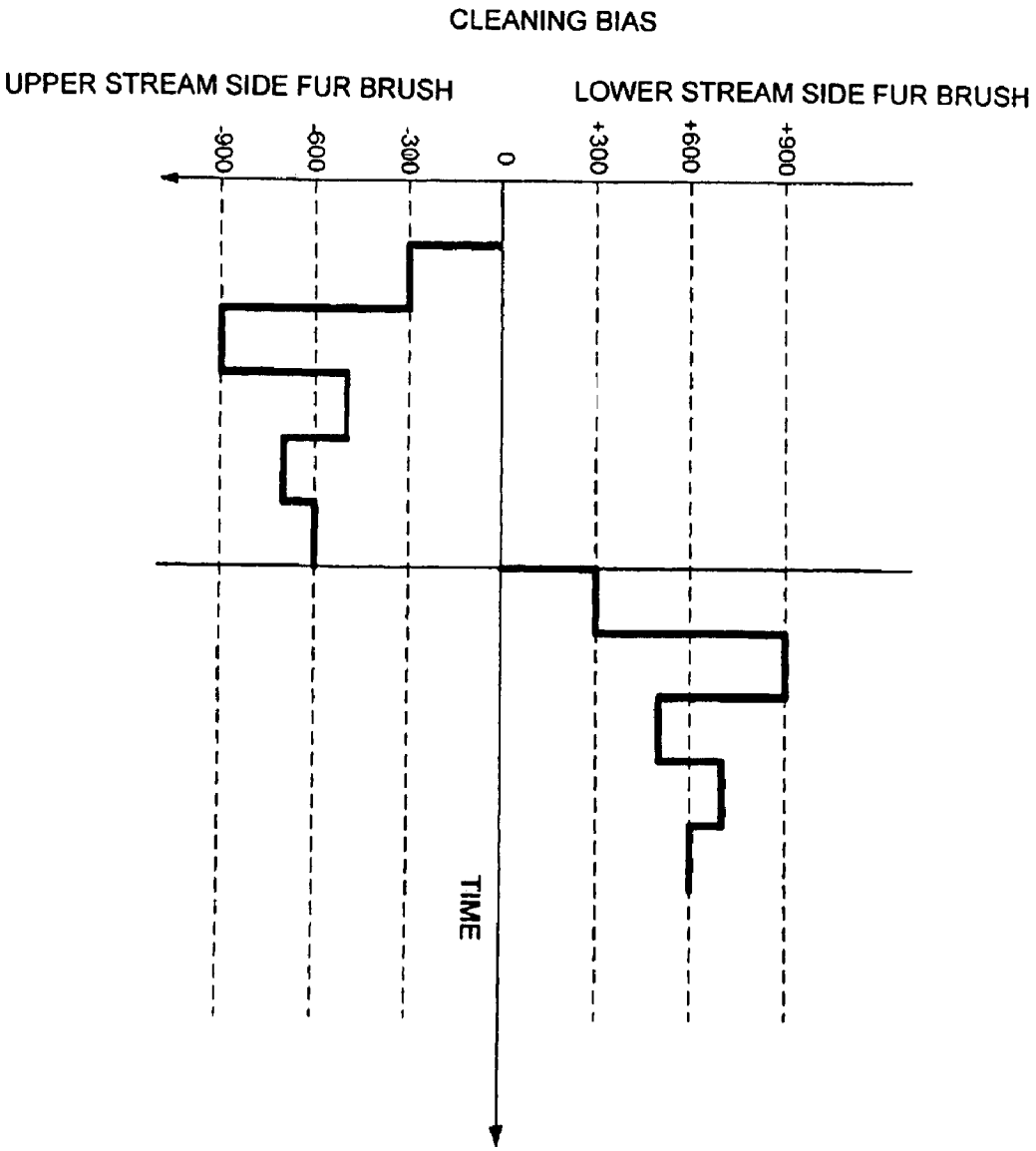
FIG. 5 is a timing chart illustrating an applying method of a cleaning bias.

The image forming apparatus according to the first embodiment is explained with reference to FIGS. 1 to 5. FIG. 1 is a sectional view explaining the image forming apparatus, FIG. 2 is a sectional view explaining the intermediate transfer belt, FIG. 3 is an explanatory diagram of the first cleaning means, FIG. 4 is a graph showing a relationship between a cleaning current and toner slipping, and FIG. 5 is a timing chart illustrating an applying method of cleaning bias.

Entire Constitution of the Image Forming Apparatus

An entire constitution of the image forming apparatus is explained. The image forming apparatus of this embodiment is a tandem type image forming apparatus where four image forming devices Pa, Pb, Pc and Pd are arranged along the intermediate transfer belt 181 as an intermediate transfer member which rotates in a direction of arrow X as shown in FIG. 1. That is to say, the four image forming devices Pa, Pb, Pc and Pd form toner images of yellow (Y), magenta (M), cyan (C) and black (K) according to an electrophotographic method. The toner images are primarily transferred to the intermediate transfer belt 181 in an overlapped manner, and the toner images are collectively transferred to a sheet as a recording medium to be transported secondarily so that an image is formed.

The yellow image forming device Pa, the magenta image forming device Pb, the cyan image forming device Pc and the black image forming device Pd are arranged in this order from an upper stream side to a lower stream side in the rotational direction of the intermediate transfer belt 181. Only colors of toner images to be formed by them are different, and their constitutions are the same.

In the image forming devices Pa, Pb, Pc and Pd, charging rollers 122*a*, 122*b*, 122*c* and 122*d* as primary charging means, exposing means 111*a*, 111*b*, 111*c* and 111*d*, developing means 123*a*, 123*b*, 123*c* and 123*d*, primary transfer rollers 124*a*, 124*b*, 124*c* and 124*d* as primary transfer means, and drum cleaning means 112*a*, 112*b*, 112*c* and 112*d* are provided around drum-shaped electrophotographic photosensitive members (hereinafter, "photosensitive member") 101*a*, 101*b*, 101*c* and 101*d* as image bearing members arranged rotatively, respectively.

The image forming operation of the yellow image forming device Pa is exemplified simply. A surface of the photosensitive drum 101*a* is uniformly charged by applying a bias to the charging roller 122*a*, and light is emitted thereto according to an image signal from the exposing means 111*a* so that an electrostatic latent image is formed. The latent image is developed using yellow toner by the developing means 123*a* so as to be a visible image. In the developing means 123*a*, the toner is charged into negative polarity. In a primary transfer device T1 as a contact portion between the photosensitive drum 101*a* and the intermediate transfer belt 181, a bias whose polarity is opposite (positive polarity) to that of the toner image is applied to the primary transfer roller 124*a* so that the toner image is primarily transferred to the intermediate transfer belt 181. The toner which remains on the photosensitive drum 101*a* after the transfer of the toner image is eliminated by the drum cleaning means 112*a*.

When the above transfer of the toner image is performed also in the other image forming devices Pb, Pc and Pd, a full-color toner image is transferred and formed on the intermediate transfer belt 181. The intermediate transfer belt 181 is wound as a supporting member around a driving roller 125, a tension roller 126 and a back-up roller 129, and when an image is formed, it rotates to a direction of arrow X at specific speed.

Meanwhile, a sheet P, which is fed from a sheet cassette 160 mounted to a lower portion of the apparatus, is transported to a secondary transfer device T2 as a contact portion between the intermediate transfer belt 181 and the secondary transfer roller (transfer means) as the secondary transfer means. When a bias whose polarity is opposite (positive polarity) to that of the toner image is applied to the secondary transfer roller 140, the toner image on the intermediate transfer belt 181 is transferred onto the transported sheet P. Further, after the sheet P is transported to a fixing means 150 and the toner is fixed thereto, the sheet P is discharged onto a discharge tray 151.

In the secondary transfer device T2, the toner which is not completely transferred from the intermediate transfer belt 181 to the sheet P is eliminated by the intermediate transfer member cleaning member 115 and 130.

{Intermediate Transfer Belt}

The intermediate transfer belt 181 is an endless belt, and it runs to the direction of arrow X at specific speed at the time of forming an image.

Further, the intermediate transfer belt 181 in this embodiment is constituted as an elastic belt having elasticity on its surface layer. Concretely, as shown in FIG. 2, it is an elastic belt having a three-layered structure composed of a resin layer 181*a*, an elastic layer 181*b* and a surface layer 181*c*.

Examples of resin materials composing the resin layer 181*a* are polycarbonate, fluorine resin (ETFE, PVDF), and polystyrene. Examples of elastic materials composing the elastic layer 181*b* (elastic rubber, elastomer) are butyl rubber, fluororubber and acrylic rubber. Materials of the surface layer 181*c* are not particularly limited, but materials that reduce adhesion force of the toner to the surface of the intermediate transfer belt 181 and heighten secondary transfer property are required. For example, polyurethane, polyester, and resin materials such as epoxy resin can be used. The surface layer 181*c* is not limited to these materials.

When the intermediate transfer belt 181 has the elastic layer 181*b* on its surface layer portion, an image having high quality without hollow character can be formed, transfer efficiency can be improved, and an amount of transfer residual toner can be reduced. Furthermore, the transfer property on thick sheets and unleveled sheets is improved.

Intermediate Transfer Belt Cleaning Device

A cleaning constitution of adhered matter such as transfer residual toner on the intermediate transfer belt 181 after secondary transfer is explained below.

The belt cleaning device in this embodiment has a first cleaning member (first eliminating means) 115 and a second cleaning member (second eliminating means) 130. The belt cleaning device is arranged on a lower stream side of the secondary transfer device T2 in the transport direction of the intermediate transfer belt 181 and on an upper stream side with respect to the primary transfer device T1 of the yellow image forming device Pa.

The first cleaning member 115 is an absorption cleaning means that applies a bias whose polarity is opposite to that of the toner remaining on the intermediate transfer belt to the cleaning member, so as to absorb and eliminate the toner using the cleaning member. In this embodiment, a fur brush as the cleaning member is rotated and a bias is applied so that cleaning is performed.

The second cleaning member 130 is a contact cleaning means that allows the cleaning member to contact with and slide with the intermediate transfer belt 181 so as to eliminate belt residual toner. In this embodiment, a web member as the cleaning member is used so as to wipe away the toner. The second cleaning means is arranged on a lower stream side in the rotational direction of the intermediate transfer belt 181 with respect to the first cleaning means, and eliminates toner which slips through the first cleaning member 115 and adhered matter on the belt.

Constitutions of the first cleaning member 115 and the second cleaning member 130 are concretely explained below.

First Cleaning Member

The constitution of the first cleaning member 115 is such that, as shown in FIG. 3, an apparatus housing 117 is arranged near the intermediate transfer belt 181, an upper stream side cleaning member 116*a* and a lower stream side cleaning member 116*b* are provided in the apparatus housing 117 along the rotational direction of the intermediate transfer belt. Both the upper stream side cleaning member 116*a* and the lower stream side cleaning member 116*b* have electrically conductive fur brushes 118*a* and 118*b*, metal rollers 119*a* and 119*b*, and cleaning blades 120*a* and 120*b*, respectively.

The fur brushes 118*a* and 118*b* according to this embodiment are constituted so that carbon diffusion type nylon fibers with resistance value of 10 MΩ and fiber thickness of 6 denier are implanted into the metal rollers with implanting density of 500000 fibers/inch$^2$. The metal rollers 119*a* and 119*b* are formed by conductive aluminum-made metal rollers whose surfaces were subject to hard alumite treatment, and the cleaning blades 120*a* and 120*b* contact with the metal rollers 119*a* and 119*b*, respectively.

The electrically conductive fur brushes 118*a* and 118*b* in this embodiment are slidably arranged with an intrusion amount of about 1.0 [mm] being maintained with respect to the intermediate transfer belt 181. The fur brushes 118*a* and 118*b* are rotated to a direction of arrow in FIG. 3 at speed of 50 [m/sec] by the driving motor, not shown.

The metal rollers 119*a* and 119*b* are arranged with an intrusion amount of about 1.0 [mm] being maintained with respect to the electrically conductive fur brushes 118*a* and 118*b*. The metal rollers 119*a* and 119*b* are arranged so as to rotate to the direction of arrow in FIG. 3 at equivalent speed to that of the electrically conductive fur brushes 118*a* and 118*b*. The cleaning blades 120*a* and 120*b* which contact with the metal rollers 119*a* and 119*b* are made of urethane rubber, and are arranged with the intrusion amount of 1.0 [mm] being maintained with respect to the metal rollers.

A DC constant voltage of −700 [V] (hereinafter, to ground) is applied from a DC power source 121*a* to the meal roller 119*a* of the upper stream side cleaning member 116*a* positioned on the upper stream side with respect to the rotational direction of the intermediate transfer belt. On the other hand, a DC constant voltage of +700 [V] having the opposite polarity to that of the upper stream cleaning member 116*a* is applied from a DC power source 121*b* to the metal roller 119*b* of the lower stream side cleaning member 116*b* positioned on the lower stream side with respect to the rotational direction of the intermediate transfer belt.

When the voltages are applied from the power sources 121*a* and 121*b* to the metal rollers 119*a* and 119*b*, respectively, in such a manner, a potential difference is generated between the fur brushes 118*a* and 118*b*, and (+) toner of the transfer residual toner on the intermediate transfer belt 181 is absorbed and transferred to the fur brush 118*a*. The absorbed and eliminated toner is further transferred from the fur brush 118*a* to the metal roller 119*a* by means of a potential difference, and is scraped off by the cleaning blade 120*a*.

Even when the transfer residual toner on the intermediate transfer belt 181 is cleaned by the upper stream side cleaning member 116*a*, toner without polarity or toner having (−) polarity remains on the intermediate transfer belt 181. Such toner is charged into (−) by a (−) bias to be applied by the fur brush 118*a* of the upper stream side cleaning member 116*a*. It is considered that this charging occurs due to injection of electric charges or discharge.

When a (+) bias voltage is applied to the lower stream side cleaning member 116*b* arranged on the lower stream side of the upper stream side cleaning member 116*a* so that cleaning is performed, the toner can be eliminated. The eliminated toner transfers from the fur brush 118*b* to the metal roller 119*b* due to a potential difference, and is scraped off by the cleaning blade 120*b*, so that the transfer residual toner on the intermediate transfer belt 181 can be entirely eliminated. The transfer residual toner on the intermediate transfer belt 181 is collected by the fur brush 118*a* or the fur brush 118*b* in the first cleaning area (first eliminating area) C1.

Since the intermediate transfer cleaning member 115 is constituted by a cleaning method using the fur brushes, a load to the intermediate transfer belt 181 is small, and thus this member 115 is effective particularly for cleaning of the elastic intermediate transfer belt.

Second Cleaning Member

In the second cleaning member 130, a cleaning web 131 is wound around a feeding roll 132*a* and a winding roll 132*b*, and contacts with the intermediate transfer belt 181 with specific pressure (in this embodiment, total pressure of 2.0 [kg]) by means of a contact roll 133.

As materials of the cleaning web 131, not less than one type or two types of materials can be selected from polyester, acryl, vinylon, soluble vinylon, rayon, nylon, polypropylene, cotton and the like. The cleaning web 131, however, is not limited to the above materials.

External additive released from toner is rubbed against and adheres to the surface of intermediate transfer belt 181 in a pressurized portion such as a transfer portion. Since the external additive cannot be collected even by the first cleaning member 115, it is mechanically collected by the cleaning web 131 in a second cleaning area (second eliminating area) C2. Some of the transfer residual toner has a less amount of electric charges. It is difficult that the first cleaning member 115 collects the toner with a less amount of electric charges. The toner which cannot be collected by the first cleaning member 115, therefore, is collected by the cleaning web 131. In this specification, the toner includes external additive.

When the same surface of the cleaning web 131 is used for a long time, an adhered matter collectable capacity of the cleaning web 131 exceeds its limit, and on the contrary, the adhered matter is rubbed against the surface of the elastic intermediate transfer belt 181. For this reason, a constant amount of the cleaning web 131 is wound around the winding roll 132*b* after certain time passes, so that the contact surface with the intermediate transfer belt 181 is renewed.

In this embodiment, the winding timing and the winding amount of the cleaning web 131 are set so that 5 mm of the cleaning web 131 is wound every time when 100 pieces of A4 sheets pass. As a result, the adhered matter to the surface of the elastic Intermediate transfer belt 181 can be eliminated satisfactorily.

In the second cleaning means, the contact roll 133 can move up and down in FIG. 1, and when the contact roll 133 moves up, the cleaning web 131 is separated from the intermediate transfer belt 181.

Bias Control Means for the Fur Brush

In the first cleaning member 115 which is used in this embodiment, the fur brushes 118*a* and 118*b* on the upper stream side and the lower stream side in the rotational direction of the intermediate transfer belt 181 collect toner having different polarities. For this reason, the upper stream side fur brush 118*a* and the lower stream side fur brush 118*b* becomes dirty differently depending on the cases where image density is high and low. In order to eliminate the transfer residual toner using such fur brushes 118*a* and 118*b*, bias voltages with the most suitable values should be applied according to the states of the fur brushes 118*a* and 118*b*.

Control means 170*a* and 170*b* that adjust the values of the bias voltages to be applied according to the states of the fur brushes 118*a* and 118*b* are provided to the image forming apparatus of this embodiment.

Adjustment of the bias voltages to be applied to the fur brushes 118*a* and 118*b* using the bias control means 170*a* and 170*b* is explained below. The values of the bias voltages to be applied to the fur brushes 118*a* and 118*b* are determined at the time of forming an image so that an electric current flows at the time of a current value of the highest cleaning performance based on values of electric currents flowing due to the bias voltages (test bias) applied to the fur brushes 118*a* and 118*b*.

In the image forming apparatus in this embodiment, when the bias voltage is applied to the fur brushes 118*a* and 118*b*, a relationship between a value of a cleaning current to flow in the tension roller 126 as a roller opposed via the intermediate transfer belt 181 and an amount of toner slipping through the fur brushes 118*a* and 118*b* at this time is shown in a graph of FIG. 4. That is to say, when the absolute value of the cleaning current is 20 [μA], the cleaning property is the best, and as the cleaning current deviates further from that value, the cleaning performance becomes worse.

In the bias control, therefore, when a non-image is formed before an image is formed, cleaning biases to the fur brushes 118*a* and 118*b* are gradually changed, a value of the electric current to flow into the opposed tension roller 126 is detected, and the value of a voltage is changed so that the value of the electric current becomes 20 [μA] which is the absolute value of the adequate value of the electric current. When the value of the applying voltage according to the adequate value of the electric current is found, the value of the voltage is determined as the cleaning bias to be applied to the fur brush 118*a* and 118*b* at the time of forming the image.

Concretely, when the adequate electric current necessary for cleaning is −20 [μA] for the upper stream side fur brush 118*a* and +20 [μA] for the lower stream side fur brush 118*b*, as shown in FIG. 5, voltages of −300 [V] and −900 [V] are applied to the upper stream side fur brush 118*a*. When the values of the electric current at the time of applying these voltages are −10 [μA] and −31 [μA], the bias value for obtaining the cleaning current of −20 [μA] is roughly calculated according to the relationship between the voltages and the electric currents.

In order to further heighten the accuracy, voltages of −550 [V] and −650 [V] are applied to the upper stream side fur brush 118*a*. In the case where the values of the electric current at the time of applying these voltages are −18 [μA] and −22 [μA], the bias value for obtaining the cleaning current of −20 [μA] is calculated as −600 [V]. The calculated bias is applied as the cleaning bias to the fur brush 118*a* at the time of forming an image.

Similarly, the voltages of +300 [V] and +900 [V] are sequentially applied to the lower stream side fur brush 118*b*, and the bias adjustment similar to that in the upper stream side fur brush 118*a* is made. That is to say, the voltages of +300 [V] and +900 [V] are applied to the lower stream side fur brush 118*b*. The values of electric current at the time of applying these voltages are measured, and the bias value for obtaining the cleaning current of 20 [μA] is roughly calculated according to the relationship between the voltage and electric current. In order to further heighten the definition, the voltages of +550 [V] and +650 [V] are applied to the lower stream side fur brush 118*b*. As a result, in this embodiment, the bias value for obtaining the cleaning current of 20 [μA] is calculated as +600 [V]. This value is applied as the cleaning bias to the fur brush 118*b* at the time of forming an image.

When the bias of the lower stream side fur brush 118*b* is adjusted, the application of the adjustment bias to the upper stream side fur brush 118*a* is stopped so that deterioration of the intermediate transfer belt 181 due to the application of bias can be suppressed.

When high voltages are applied to the fur brushes 118*a* and 118*b* at the time of the bias adjustment, the polarities of the electric charges of the toner collected by the fur brushes 118*a* and 118*b* are inverted by intrusion of the electric charges due to injection of electric charges or discharge. As a result, the toner is discharged from the fur brushes 118*a* and 118*b* to the intermediate transfer belt 181.

A lot of toner is discharged from the fur brushes 118*a* and 118*b*, a lot of toner and external additive are accumulated on the cleaning web 131 of the second cleaning member 130 arranged on the lower stream side of the first cleaning member 115. As a result, the cleaning web 131 rubs adhered matter against the intermediate transfer belt 181 in a manner opposite to an original movement, so that the resistance value of the intermediate transfer belt 181 fluctuates.

For example, in the above example of the embodiment, the bias of −800 [V] is applied to the upper stream side fur brush 118*a* and the bias of +800 [V] is applied to the lower stream side fur brush 118*b*, the toner is started to be discharged from the fur brushes 118*a* and 118*b* to the intermediate transfer belt 181.

The image forming apparatus in this embodiment is, therefore, constituted so that when the bias voltage (test bias) is applied to the fur brushes 118*a* and 118*b* at the time of the bias control, the cleaning web 131 is separated from the intermediate transfer belt 181. After the bias control steps are completed, the cleaning web 131 is brought into contact with the intermediate transfer belt 181, and the sequence moves to normal image forming steps.

Even if the resistance of the fur brushes fluctuates due to, for example, toner contamination, the cleaning bias according to the adequate electric current can be set. At the time of the bias adjustment, a higher voltage than the adequate bias value is occasionally applied to the fur brushes 118*a* and 118*b*, and the cleaning web 131 is separated from the intermediate transfer belt 181. As a result, the toner can be prevented from being accumulated on the cleaning web 131.

SECOND EMBODIMENT

The above-mentioned embodiment explains an example that the application of the bias to the upper stream side fur brush 118*a* is stopped at the time of applying the adjusted bias to the lower stream side fur brush 118*b*. In the case, however, where the upper stream side fur brush 118*a* and the lower stream side fur brush 118*b* are arranged so as to be close to each other, an influence of the belt residual electric charges which is exerted on the upper stream side fur brush

Figure 6:
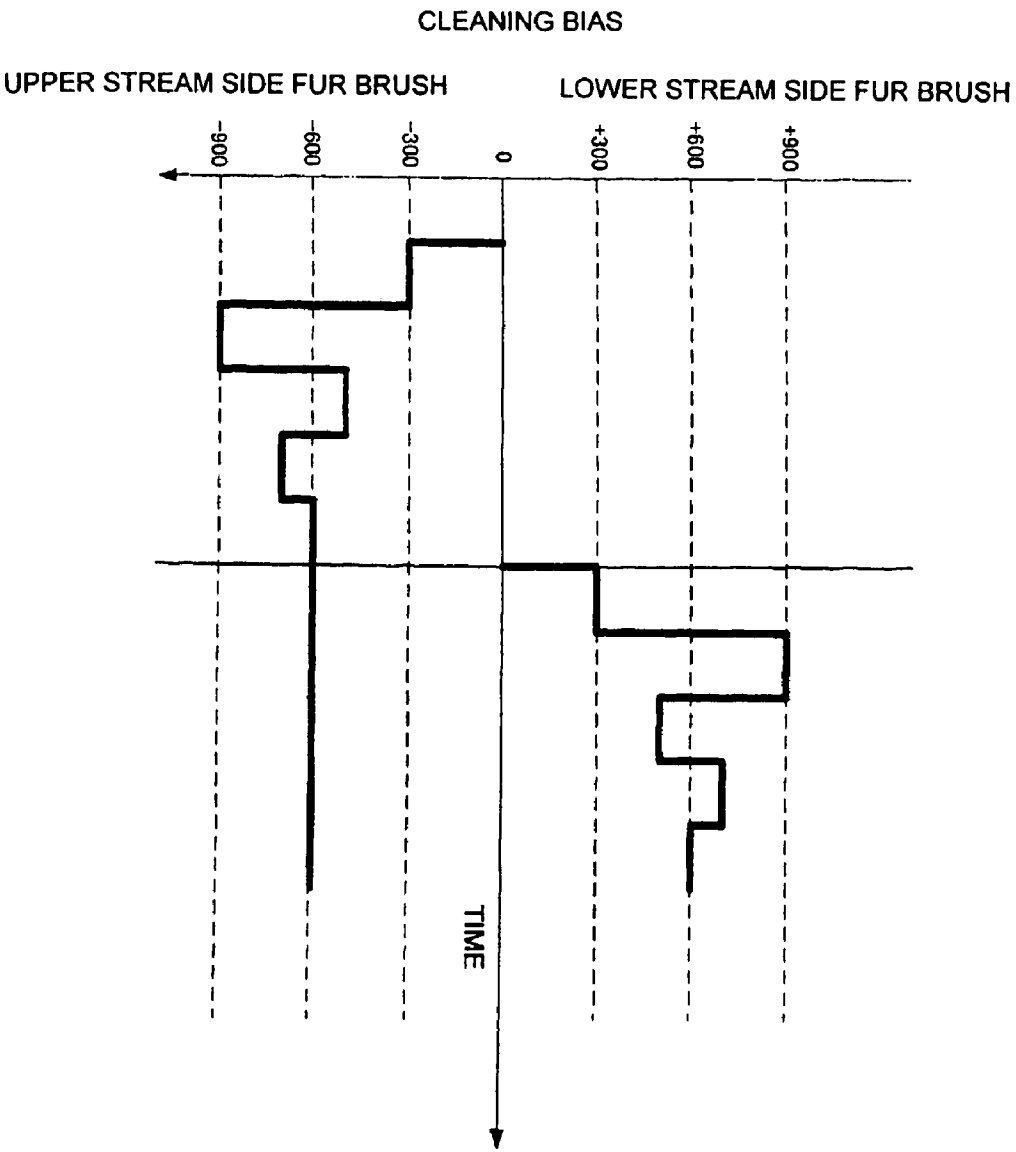
FIG. 6 is a timing chart illustrating an applying method of a cleaning bias.

118*a* is occasionally exerted on the lower stream side fur brush 118*b*. In this case, the influence of only the residual electric charges of the intermediate transfer belts 181 is exerted, the influence of the upper stream side is exerted on the lower stream side fur brush 118*b*. As shown in FIG. 6, therefore, the bias to the upper stream side fur brush 118*b* is firstly adjusted, and while the adjusted cleaning bias is being applied, the bias to the lower stream side fur brush 118*b* is adjusted. As a result, the cleaning bias to the lower stream side fur brush 118*b* can be set after the influence of the residual electric charges which is exerted on the intermediate transfer belt 181 in the position of the upper stream side fur brush 118*a* is taken into consideration.

ANOTHER EMBODIMENT

Figure 7:
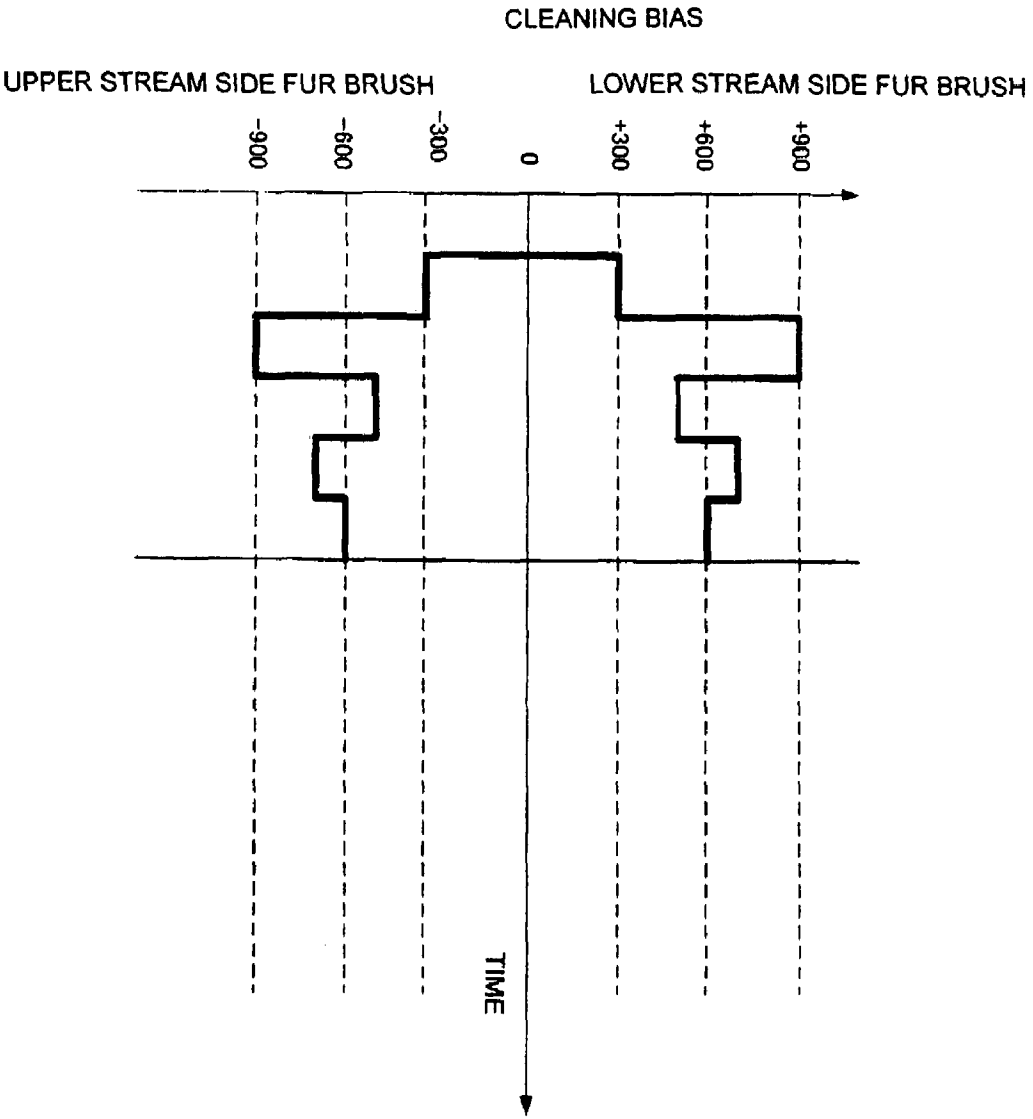
FIG. 7 is a timing chart illustrating an applying method of a cleaning bias.

The above-mentioned embodiment explains an example where the bias to the upper stream side fur brush 118*a* is firstly adjusted, and then the bias to the lower stream side fur brush 118*b* is adjusted. As shown in FIG. 7, however, the biases to the upper stream side fur brush 118*a* and the lower stream side fur brush 118*b* may be adjusted simultaneously. As a result, the bias adjusting time can be shortened to half.

In the above embodiment, at the time of adjusting the bias, four voltages are gradually applied, but when the number of voltage applications is increased, the cleaning bias can be adjusted with higher definition. On the contrary, when the number of the voltage applications is decreased, the cleaning bias can be adjusted more simply for a shorter time.

In the above embodiment, the bias to the upper stream side fur brush 118*a* is firstly adjusted, but the influence of the residual electric charges on the intermediate transfer belt 181 is small, the bias to the lower stream side fur brush 118*b* is firstly adjusted so that the same effect can be obtained.

The above embodiment explains an example where the adjustment of the biases to be applied to the fur brushes 118*a* and 118*b* is determined according to flowing electric current, but an adjustment electric current is allowed to flow at the time of adjusting the bias, and based on a voltage value detected at this time, the bias to be applied at the time of forming an image may be determined.

Figure 8:
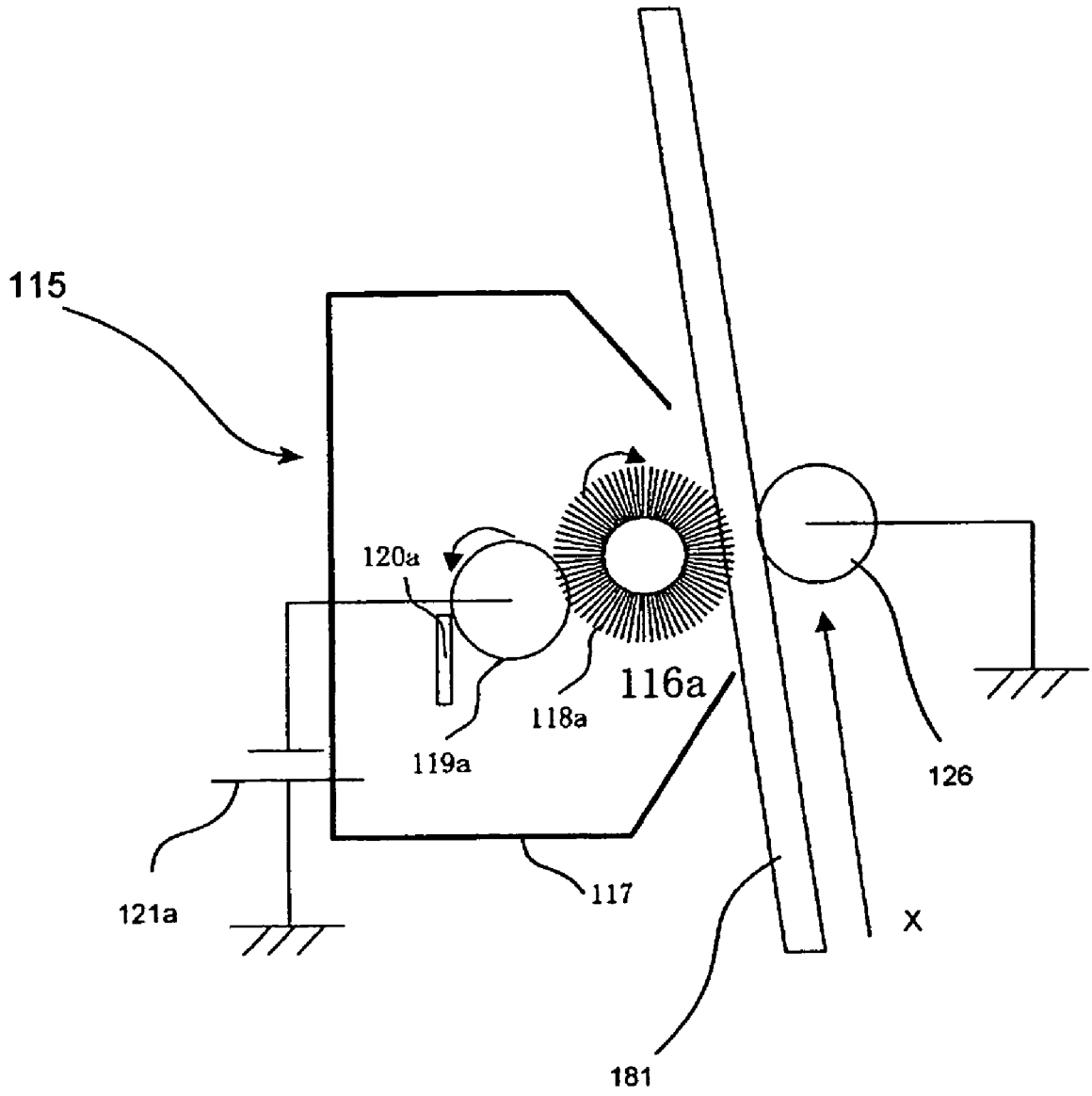
FIG. 8 is an explanatory diagram illustrating a first cleaning means having one fur brush.

The above embodiment explains an example where two fur brushes 118*a* and 118*b* are provided as the first cleaning member 115. The first cleaning means, however, may be constituted so as to have one fur brush 118*a* as shown in FIG. 8. For example, in the image forming apparatus that forms a toner image of minus, since most of the secondary transfer residual toner has plus polarity, bias with minus polarity is applied to one fur brush, so that the toner on the intermediate transfer belt can be eliminated.

Also in this case, in order to adjust the bias to the fur brush, when the bias voltage (test bias) is applied to the fur brush, the cleaning web 131 on the lower stream side with respect to the fur brush is separated from the intermediate transfer belt 181. As a result, even if toner is discharged from the fur brush onto the intermediate transfer belt 181 at the time of adjusting the bias, the toner can be prevented from being accumulated on the cleaning web 131.

This application claims the benefit of priority from the prior Japanese Patent Application No. 2005-074964 filed on Mar. 16, 2005 the entire contents of which are incorporated by reference herein.

What is claimed is:

1. An image forming apparatus, comprising:

an image bearing member that bears a toner image and moves;

transfer means that transfers the toner image on the image bearing member to a transfer medium;

first eliminating means that comes in contact with the image bearing member and collects and eliminates toner on the image bearing member by applying a bias in a first eliminating area where the toner is eliminated from the image bearing member;

second eliminating means that comes in contact with the image bearing member so as to eliminate the toner on the image bearing member in a second eliminating area where the toner remaining on the image bearing member where the toner is eliminated in the first eliminating area is eliminated;

control means that variably controls a bias condition of the bias to be applied to the first eliminating means based on a relationship between voltage and electric current at the time of applying test bias to the first eliminating means in contact with the image bearing member; and separating means that separates the second eliminating means from the image bearing member when a portion of the image bearing member which passes through the first eliminating area during the application of the test bias to the first eliminating means is in the second eliminating area.

2. The image forming apparatus according to claim 1, wherein the first eliminating means includes an upper stream side eliminating member to which a bias with a specific polarity is applied, and a lower stream side eliminating member which is arranged on a lower stream side in the eliminating direction of the image bearing member with respect to the upper stream side eliminating member and to which a bias with polarity opposite to the specific polarity is applied.

3. The image forming apparatus according to claim 2, wherein the control means variably controls a bias condition of the bias to be applied when the upper stream side member collects and eliminates the toner from the image bearing member, and while the controlled bias is being applied to the upper stream side member, the control means variably controls a bias condition of the bias to be applied when the lower stream side member collects and eliminates the toner from the image bearing member.

4. The image forming apparatus according to claim 2, wherein the control means applies the test bias to the upper stream side eliminating member and the lower stream side eliminating member simultaneously at the time of bias control so as to variably change the bias condition.

5. The image forming apparatus according to any one of claims 1 to 4, wherein a constant voltage is applied to the first eliminating means when the toner is collected and eliminated from the image bearing member.

6. An image forming apparatus, comprising:

a movable image bearing member that bears a toner image;

transfer means that transfers the toner image on the image bearing member to a transfer medium;

first cleaning means to which a cleaning voltage is applied while coming in contact with the image bearing member, and cleans toner from the image bearing member at a first eliminating area;

second cleaning means that comes in contact with the image bearing member and removes residual toner that has not been removed by the first cleaning means at a second eliminating area , the second cleaning means being provided at a downstream side of the first cleaning means in a direction in which the image bearing member moves;

control means that controls the cleaning voltage applied to the first cleaning means based on an electric current value or a voltage value when a test bias is applied to the first cleaning means; and separation means that separates the second cleaning means from the image bearing member so that the second cleaning means is in a state of being separated from the image bearing means when a portion of the image bearing member having passed through the first eliminating area as the application of the test bias to the first cleaning means is in the second eliminating area.

7. The image forming apparatus according to claim 6, wherein the first cleaning means includes a brush member that comes in contact with the image bearing member and removes toner therefrom.

8. The image forming apparatus according to claim 7, wherein the first cleaning means further includes first and second brush members, and the cleaning voltages having opposite polarities from each other are applied to the first and second brush members, respectively.

* * * * *

UNITED STATES PATENT AND TRADEMARK OFFICE

CERTIFICATE OF CORRECTION

PATENT NO. : 7,251,430 B2
APPLICATION NO. : 11/354084
DATED : July 31, 2007
INVENTOR(S) : Akihiro Nishikawa It is certified that error appears in the above-identified patent and that said Letters Patent is hereby corrected as shown below:

COLUMN 1:
Line 15, “reduce” should read --reduction--.
Line 16, “cost,” should read --costs,--.
Line 17, “desirably” should read --a desirably--.

COLUMN 5:
Line 37, “arrow” should read --the arrow--.

COLUMN 8:
Line 38, “is started to be” should read --starts to--.
Line 39, “discharged” should read --discharge--.

COLUMN 9:
Line 3, “belts” should read --belt--.
Line 11, “is” should read --are--.

COLUMN 10:
Line 22, “test” should read --a test--.

COLUMN 11:
Line 8, “area ,” should read --area,--.

Signed and Sealed this

Twenty-fifth Day of March, 2008

JON W. DUDAS
*Director of the United States Patent and Trademark Office*